US010511915B2

(12) United States Patent
Miller et al.

(10) Patent No.: US 10,511,915 B2
(45) Date of Patent: Dec. 17, 2019

(54) LISTENING DEVICE FOR MITIGATING VARIATIONS BETWEEN ENVIRONMENTAL SOUNDS AND INTERNAL SOUNDS CAUSED BY THE LISTENING DEVICE BLOCKING AN EAR CANAL OF A USER

(71) Applicant: Facebook Technologies, LLC, Menlo Park, CA (US)

(72) Inventors: Antonio John Miller, Sammamish, WA (US); Ravish Mehra, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/892,185

(22) Filed: Feb. 8, 2018

(65) Prior Publication Data

US 2019/0246217 A1 Aug. 8, 2019

(51) Int. Cl.
*H04R 25/00* (2006.01)
*H04R 1/10* (2006.01)

(52) U.S. Cl.
CPC ..... *H04R 25/353* (2013.01); *H04R 1/1016* (2013.01); *H04R 25/305* (2013.01); *H04R 2225/025* (2013.01)

(58) Field of Classification Search
CPC . H04R 25/00; H04R 2225/49; H04R 2460/01
(Continued)

(56) References Cited

U.S. PATENT DOCUMENTS 6,920,227 B2 * 7/2005 Chalupper ..... H04R 25/453 381/312
2003/0012391 A1 * 1/2003 Armstrong ..... H04R 25/356 381/312

(Continued)

FOREIGN PATENT DOCUMENTS

KR 10-2016-0091620 A 8/2016

OTHER PUBLICATIONS

QuietControl30 Wireless Headphones, Bose, 2017, 6 pages, [Online] [Retrieved on Sep. 14, 2017] Retrieved from the Internet<URL:https://www.bose.com/en_us/products/headphones/earphones/quietcontrol-30.html#v=qc30_black>.

(Continued)

*Primary Examiner* — Suhan Ni
(74) *Attorney, Agent, or Firm* — Fenwick & West LLP

(57) ABSTRACT

A listening device includes a reference microphone positioned outside a blocked ear canal of a user to receive environmental sounds and generate first signals based on the environmental sounds. A loudspeaker is coupled to the reference microphone and positioned inside the ear canal to generate internal sounds based on the first signals. An internal microphone is positioned inside the ear canal to receive the internal sounds from the loudspeaker and generate second signals based on the internal sounds. A controller is coupled to the internal microphone and the reference microphone to compute a transfer function based on the first signals and the second signals. The transfer function describes a variation between the environmental sounds and the internal sounds caused by the listening device blocking the ear canal. The controller adjusts, based on the transfer function, the internal sounds to mitigate the variation.

18 Claims, 4 Drawing Sheets

(58) Field of Classification Search
USPC ..... 381/312–313, 316–318
See application file for complete search history.

(56) References Cited

U.S. PATENT DOCUMENTS

| | | | | |
|---|---|---|---|---|
| 2007/0206825 | A1 | 9/2007 | Thomasson | |
| 2008/0063228 | A1* | 3/2008 | Mejia | H04R 25/502 381/318 |
| 2008/0107287 | A1 | 5/2008 | Beard | |
| 2009/0086988 | A1 | 4/2009 | Ou et al. | |
| 2016/0241948 | A1 | 8/2016 | Liu et al. | |

OTHER PUBLICATIONS

HereOne Here Buds, Doppler Labs Inc., 2017, 5 pages, [Online] [Retrieved on Sep. 14, 2017] Retrieved from the Internet<URL:https://hereplus.me/pages/product-details#listen>.

PCT International Search Report and Written Opinion, PCT Application No. PCT/US2018/067258, dated Apr. 23, 2019, 13 pages.

* cited by examiner

LISTENING DEVICE FOR MITIGATING VARIATIONS BETWEEN ENVIRONMENTAL SOUNDS AND INTERNAL SOUNDS CAUSED BY THE LISTENING DEVICE BLOCKING AN EAR CANAL OF A USER

BACKGROUND

This disclosure relates generally to stereophony and specifically to a listening device for mitigating a variation between environmental sounds and internal sounds caused by the listening device blocking an ear canal of a user.

Humans derive spatial cues and balance from environmental sounds that travel through the air, bounce off the pinna and concha of the exterior ear, and enter the ear canal. The environmental sounds vibrate the tympanic membrane, causing nerve signals to travel to the brain. However, headphones or in-ear-monitors that block the ear canal and transmit sounds to a listener's ear can result in a reduction or loss of directional cues in the transmitted sounds. The reduction in directional cues can reduce the listener's situational awareness.

Losing the ability to derive situational cues from ambient sounds can lead to the listener experiencing dissatisfaction with the headphones or in-ear-monitor and lead the listener to stop wearing the devices.

SUMMARY

Embodiments relate to a listening device for adjusting and transmitting environmental sounds to a user on-the-fly as the user is participating in an artificial reality experience. In one embodiment, the user wears the listening device for listening to artificial audio content in an artificial reality environment. The listening device includes a reference microphone positioned outside a blocked ear canal of a user wearing the listening device to receive the environmental sounds and generate first signals based in part on the environmental sounds. A loudspeaker is coupled to the reference microphone and positioned inside the ear canal. The loudspeaker generates internal sounds based in part on the first signals. An internal microphone is positioned inside the ear canal to receive the internal sounds from the loudspeaker and generate second signals based in part on the internal sounds. A controller is coupled to the internal microphone and the reference microphone. The controller computes a transfer function based in part on the first signals and the second signals. The transfer function describes a variation between the environmental sounds and the internal sounds. The variation may be caused by the listening device blocking the ear canal and the internal sounds bouncing off the surfaces of the ear canal and the ear. This unwanted variation may add a bias to the reproduced environmental sounds as perceived by the user. The controller adjusts, based on the transfer function, the internal sounds to mitigate the variation.

Some embodiments describe a method for receiving environmental sounds by a reference microphone positioned outside a blocked ear canal of a user wearing a listening device. First signals are generated based in part on the environmental sounds. Internal sounds are generated, based in part on the first signals, by a loudspeaker coupled to the reference microphone and positioned inside the ear canal of the user. The internal sounds are received from the loudspeaker by an internal microphone positioned inside the ear canal of the user. Second signals are generated based in part on the internal sounds. A transfer function is computed based in part on the first signals and the second signals. The transfer function describes a variation between the environmental sounds and the internal sounds caused by the listening device blocking the ear canal of the user. Based in part on the transfer function, the internal sounds are adjusted to mitigate the variation.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Overview

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including an HMD connected to a host computer system, a standalone HMD, a mobile device or computing system, or any other hardware platform capable of providing artificial reality content to one or more viewers.

An artificial reality system may present artificial audio content to a user using a listening device such that the user experiences an artificial reality environment. The listening device may partially or fully block the ear or ear canal of the user to present a more realistic sound environment or simply because of the manner in which the listening device is designed. The embodiments described herein adjust and transmit environmental sounds received by the listening device on-the-fly to the user while artificial audio content is being presented to the user. In an embodiment, the listening device may transmit only the environmental sounds to the user or adjust the environmental sounds relative to the received artificial audio content. The listening device may mix the environmental sounds with the received artificial audio content. The listening device may increase or decrease a level of the environmental sounds relative to a level of the received artificial audio content. The listening device may also block the environmental sounds and transmit only the received artificial audio content to the user.

Figure 1:
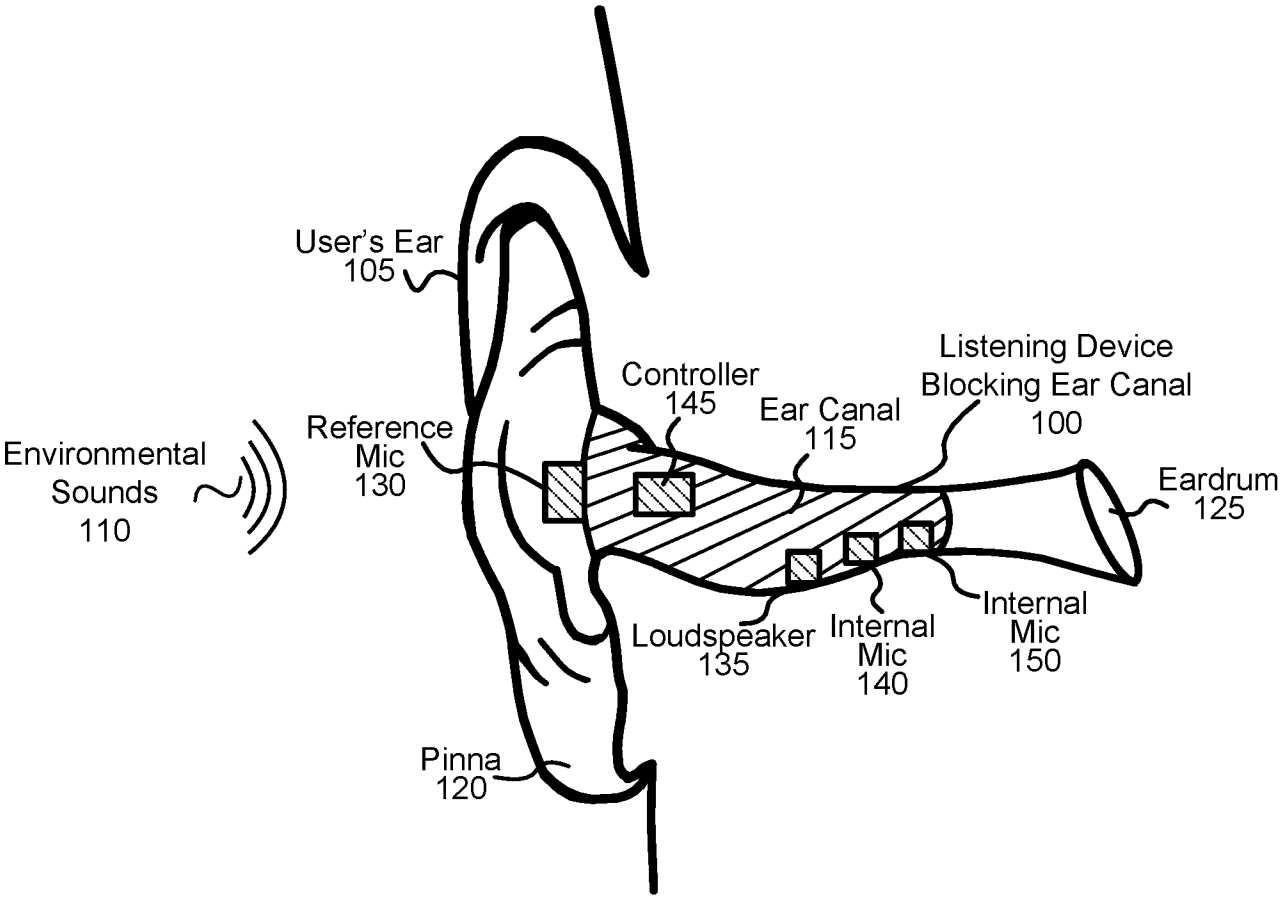
FIG. 1 is an example view of a listening device within a user's ear for mitigating a variation between environmental sounds and internal sounds caused by the listening device blocking an ear canal of the user, in accordance with one or more embodiments.

Listening Device for Mitigating a Variation Between Environmental Sounds and Internal Sounds FIG. 1 is an example view of a listening device 100 within a user's ear 105 for mitigating a variation between environmental sounds 110 and internal sounds caused by the listening device 100 blocking an ear canal 115 of the user, in accordance with one or more embodiments. The listening device 100 is positioned within the user's ear 105 for transmitting hybrid audio content including adjusted environmental sounds and artificial reality audio content to the user, in accordance with an embodiment. The listening device 100 may be worn by itself on the user's ear 105, or as part of a set of headphones or head-mounted display (HMD) worn on the user's head. Such an HMD may also reflect projected images and allow the user to see through it, display computer-generated imagery (CGI), live imagery from the physical world, or may allow CGI to be superimposed on a real-world view (referred to as augmented reality or mixed reality).

FIG. 1 shows the ear 105 of the user. The ear 105 includes a pinna 120, the ear canal 115, and an eardrum 125. The pinna 120 is the part of the user's ear 105 made of cartilage and soft tissue so that it keeps a particular shape but is also flexible. The ear canal 115 is a passage comprised of bone and skin leading to the eardrum 125. The ear canal 115 functions as an entryway for sound waves, which get propelled toward the eardrum 125. The eardrum 125, also called the tympanic membrane, is a thin membrane that separates the external ear from the middle ear (not shown in FIG. 1). The function of the eardrum 125 is to transmit sounds (e.g., the environmental sounds 110) from the air to the cochlea by converting and amplifying vibrations in air to vibrations in fluid.

The listening device 100 of FIG. 1 adjusts the environmental sounds 110, and transmits the adjusted environmental sounds and received artificial audio content to the user. The listening device 100 is intended to be placed or inserted into the ear 105 in a manner to block the ear canal 115. For example, the listening device 100 may block the ear canal 115 to isolate received artificial audio content provided by an artificial reality system coupled to the listening device 100 using a wired connection or a wireless connection. The listening device 100 includes a reference microphone 130, a loudspeaker 135, one or more internal microphones 140 and/or 150, and a controller 145. In other embodiments, the listening device 100 may include additional or fewer components than those described herein. Similarly, the functions can be distributed among the components and/or different entities in a different manner than is described here.

The reference microphone 130 receives the environmental sounds 110 and generates first signals (e.g., electrical signals or some other transducer signals) based in part on the environmental sounds 110. The reference microphone 130 is positioned outside the blocked ear canal 120 of the user wearing the listening device 100. The reference microphone 130 may include a transducer that converts air pressure variations of the environmental sounds 110 to the first signals. For example, the reference microphone 130 may include a coil of wire suspended in a magnetic field, a vibrating diaphragm, a crystal of piezoelectric material, some other transducer, or a combination thereof. The first signals generated by the reference microphone 130 are processed by the listening device 100 to transmit the internal sounds into the ear canal 115 and towards the eardrum 125.

The loudspeaker 135 receives the first signals (e.g., electrical signals) from the reference microphone and generates the internal sounds based in part on the first signals. The loudspeaker 135 also transmits artificial audio content received by the listening device 100 to the user. The loudspeaker 135 may be coupled to the reference microphone 130 using a wired connection or a wireless connection. The loudspeaker 135 is positioned inside the ear canal 115 of the user. The loudspeaker 135 may include an electroacoustic transducer to generate the internal sounds based in part on the first signals and the received artificial audio content. For example, the loudspeaker 135 may include a voice coil, a piezoelectric speaker, a magnetostatic speaker, some other mechanism to convert the first signals and the received artificial audio content to the internal sounds, or a combination thereof. The internal sounds generated by the loudspeaker 135 are transmitted to the eardrum 125.

The internal microphone 140 acts as a monitor by receiving the internal sounds from the loudspeaker and generating second signals (e.g., electrical signals or some other transducer signals) based in part on the internal sounds. The second signals are used by the listening device 100 to monitor and correct for variations between the environmental sounds 110 received by the reference microphone 130 at the entrance of the user's ear 105 and the internal sounds generated by the loudspeaker 135. The internal microphone 140 is also positioned inside the ear canal 115 of the user. The internal microphone 140 may include a transducer to convert the internal sounds to the the second signals by any of the several methods described above with respect to the reference microphone 130.

The internal microphone 140 may be sensitive to changes in position within the ear canal 115, e.g., when the user tilts or moves her head or moves the listening device 100. To correct for this sensitivity to changes in position of the internal microphone 140, the optional second internal microphone 150 may be used to determine an acoustic pressure of the internal sounds received by the second internal microphone 150 and correct for variations between the acoustic pressure of the internal sounds and an acoustic pressure of the environmental sounds 110 received by the reference microphone 130.

The controller 145 uses a combination of acoustic measurement and model fitting to correct for variations between the environmental sounds 110 received at the entrance of the user's ear 105 and the internal sounds generated by the loudspeaker near the eardrum 125. The controller 145 may be an analog or digital circuit, a microprocessor, an application-specific integrated circuit, some other implementation, or a combination thereof. The controller 145 may be implemented in hardware, software, firmware, or a combination thereof. The controller 145 is coupled to the internal microphone 140 and the reference microphone 130. The controller 145 may be coupled to the reference microphone 130, the loudspeaker 135, and the internal microphones 140 and/or 150 using wired and/or wireless connections. In embodiment, the controller 145 may be located external to the ear canal 115. For example, the controller 145 may be located behind the pinna 120, on an HMD, on a mobile device, on an artificial reality console, etc.

The mechanical shape and/or the electrical and acoustic transmission properties of the listening device 100, and the sounds bouncing off the user's ear canal 115 may add a bias to the environmental sounds 110 when they are reproduced by the loudspeaker 135 as internal sounds and received by the internal microphone 140. This bias may be represented as a transfer function between the internal sounds and the environmental sounds 110. The transfer function results from the shape and sound reflection properties of the components of the listening device 100 and the ear 105 (including ear canal 115). The transfer function is personal to each user based on her personal ear characteristics. The transfer function alters the environmental sounds 110 so that the user hears a distorted version of the environmental sounds 110. In other words, the listening device 100 converts the received environmental sounds 110 to the internal sounds based in part on the transfer function. The transfer function may be represented in the form of a mathematical function H(s) relating the output or response (e.g., the internal sounds) to the input or stimulus (e.g., the environmental sounds 110).

In one embodiment, the transfer function H(s) describes a variation between the environmental sounds 110 and the internal sounds. The variation is caused by the listening device blocking 100 the ear canal 120 of the user. The variation may be based in part on the mechanical shape and electrical and acoustic transmission properties of the listening device 100, and the shape and sound reflection properties of the ear 105 (including ear canal 115). The internal sounds that reach the user may therefore mask the situational cues present in the environmental sounds 110, or provide incorrect or inadequate spatial cues and situational awareness to the user when she is wearing the listening device 100.

The controller 145 corrects for the bias in the internal sounds by computing the transfer function H(s) based in part on the first signals and the second signals. The controller 145 uses the computed transfer function H(s) to pre-process the first signals (e.g., by using an inverse of the computed transfer function) to mitigate effects of the transfer function H(s) from the internal sounds. In an embodiment, the controller 145 may use the second internal microphone 150 to perform acoustic outlier measurement with particle blocking at the entrance to the eardrum 125 to replicate the acoustic pressure field observed at the reference microphone 130 to account for sub-mm differences in placement of the internal microphone 140. In this embodiment, the controller 145 may adjust the internal sounds to mitigate variations between the acoustic pressure of the environmental sounds 110 received by the reference microphone 130 and the acoustic pressure of the internal sounds.

The benefits and advantages of the embodiments disclosed are that the listening device 100 may be positioned in the blocked ear canal 120 to encode the environmental sounds 110 and determine a personalized audio fingerprint of the user for localization, such that the user retains auditory situational awareness. The loudspeaker 135 and the internal microphones 140 and 150 are deeply seated in the ear canal 115 to reproduce the internal sounds captured at the ear canal 115 and remove the transfer function effect of the listening device 100 by calibration of the internal sounds individually to each user.

Architectural Block Diagram of a Listening Device Using a Controller

Figure 2:
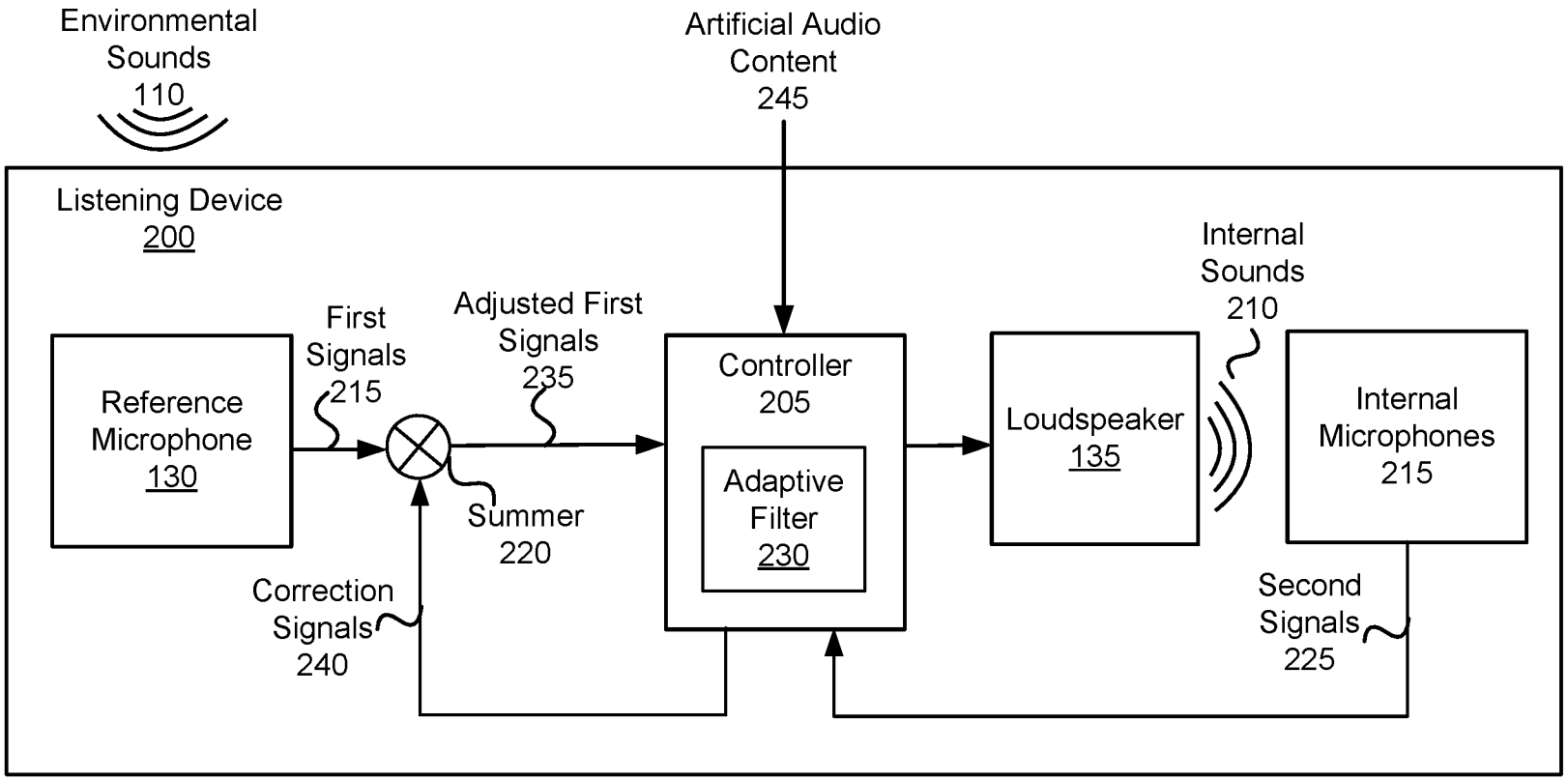
FIG. 2 is an example architectural block diagram of a listening device using a controller for mitigating a variation between environmental sounds and internal sounds caused by the listening device blocking an ear canal of the user, in accordance with one or more embodiments.

FIG. 2 is an example architectural block diagram of a listening device 200 using a controller 205 for mitigating a variation between environmental sounds (e.g., 110) and internal sounds 210 caused by the listening device 200 blocking an ear canal (e.g., 115) of the user, in accordance with one or more embodiments. The listening device 200 may be an embodiment of the listening device 100 shown in FIG. 1 and the controller 205 may be an embodiment of the controller 145 shown in FIG. 1. The listening device 200 includes a reference microphone (e.g., 130), the controller 205, a loudspeaker (e.g., 135), one or more internal microphones 215, and a summer 220. The internal microphones 215 may be an embodiment of the one or more internal microphones 140 and/or 150. In other embodiments, the listening device 200 comprises additional or fewer components than those described herein. Similarly, the functions can be distributed among the components and/or different entities in a different manner than is described here.

The reference microphone receives the environmental sounds 110 at the entrance to the user's ear (e.g., 105) and generates first signals 215 (e.g., electrical signals or some other transducer signals) based in part on the environmental sounds 110. The reference microphone 130 is positioned outside the blocked ear canal 115 of the user wearing the listening device 200. The first signals 215 may be electrical signals (e.g., voltage, current, digital signals, or a combination thereof) generated by the reference microphone 130 by any of the methods described above with reference to FIG. 1.

The loudspeaker 135 generates the internal sounds 210 based in part on the first signals 215 (as adjusted by the controller 205) to transmit the internal sounds 210 to the eardrum 125. The loudspeaker 135 is positioned inside the ear canal 115 of the user. The loudspeaker 135 may be coupled to the reference microphone 130 and the controller 205 using a wired connection or a wireless connection.

The internal microphones 215 are used to determine and correct for variations between the environmental sounds 1101 and the internal sounds 210 captured by the internal microphones 215. The internal sounds 210 are transmitted along the ear canal 115 to the eardrum 125 for sound perception. The internal microphones 215 are also positioned inside the ear canal 115 of the user and may be coupled to the controller 205 using a wired or wireless connection. At least one of the internal microphones 215 receives the internal sounds 210 from the loudspeaker 135 and generates second signals 225 based in part on the internal sounds 210.

A second one of the internal microphones 215 is used to perform acoustic power correction. The acoustic power of the environmental sounds 110 may be determined as acoustic power=acoustic pressure x particle velocity. The acoustic power of the internal sounds 210 may be similarly determined. The acoustic power is invariant to small changes in position of the internal microphone 215 while the acoustic pressure may vary with the physical position of the internal microphone 215 and the characteristics of the ear canal 115. When only a single internal microphone 215 is used to compute the transfer function between the internal sounds 210 and the environmental sounds 110, the transfer function computed may be sensitive to small changes in the physical position of the internal microphone 215 relative to the ear canal 115. The transfer function is therefore individualized per user and may act like an acoustic fingerprint. The second one of the internal microphones 215 is therefore used to correct the internal sounds 210 to reproduce the same acoustic pressure at the eardrum 125 that is observed at the reference microphone 130 when the user is in a particular environment.

The controller 205 is used to monitor the first signals 215 and the second signals 225, and correct for variations between the environmental sounds 110 and the internal sounds 210. The controller 205 may include an optional adaptive filter 230 to filter the first signals 215 to correct for the variations between the environmental sounds 110 and the internal sounds 210. The controller may be coupled to the reference microphone 130, the loudspeaker 135, and the internal microphones 215 using wired connections and/or wireless connections.

The controller 205 receives and may sample the first signals 215 and the second signals 225. For example, the controller 205 may analyze the behavior of the first signals 215 and the second signals 220 with respect to how they vary with respect to time. The controller 205 computes a transfer function (e.g., H(s)) based in part on the first signals 215 and the second signals 225. The transfer function H(s) describes a variation between the environmental sounds 110 and the internal sounds 210. The controller 205 may compute the transfer function H(s) using a domain transform based on the second signals 225 and the first signals 215. For example, if the continuous-time input signal x(t) represents the first signals 215 and the continuous-time output y(t) represents the second signals 225, the controller 205 may map the Laplace transform of the second signals $Y(s)=L\{y(t)\}$ to the Laplace transform of the first signals $X(s)=L\{x(t)\}$. The transfer function may therefore computed as $H(s)=Y(s)/X(s)$. In other embodiments, other domain transforms such as Fourier transforms, Fast Fourier transforms, Z transforms, some other domain transform, or a combination thereof may be used.

The controller 205 adjusts the first signals 215 based on the transfer function H(s) to generate adjusted first signals 235 to mitigate the variation between the environmental sounds 110 and the internal sounds 210. In one embodiment, the controller 205 adjusts the first signals 215 by generating correction signals 240. The correction signals 225 may be electrical signals (e.g., voltage, current, digital signals, or a combination thereof). The correction signals 240 may be based in part on an inverse I(s) of the transfer function H(s). The controller 205 may transmit the correction signals 240 to the summer 220 to adjust the first signals 215 to mitigate effects of the transfer function H(s) from the internal sounds.

The summer 220 adjusts the first signals 215 to generate the adjusted first signals 235. The adjusted first signals 235 may be a voltage, current, digital signal, or a combination thereof. The summer may subtract the correction signals 240 from the first signals 215 to generate the adjusted first signals 235. For example, if C(s) represents the correction signals 240, the adjusted first signals 235 may be represented as $X(s)-C(s)$. The correction signals 240 may instruct the summer to adjust certain frequencies, amplitudes, some other characteristics, or a combination thereof, of the first signals 215. The correction signals 240 are used to adjust the first signals 215 (and the internal sounds 210) such that the user perceives the internal sounds 210 as being closer to the original environmental sounds 110.

In alternative embodiments, the controller 205 may adjust the internal sounds 210 by transmitting correction signals (e.g., corresponding to an inverse I(s) of the transfer function H(s)) to the loudspeaker 135 to mitigate effects of the transfer function H(s) from the internal sounds 210. These correction signals may be may be electrical signals (e.g., voltage, current, digital signals, or a combination thereof) to instruct the loudspeaker 135 to adjust certain frequencies, amplitudes, some other characteristics, or a combination thereof, of the internal sounds 210 to more closely match the environmental sounds 110.

In an embodiment, the controller 205 may perform acoustic power correction of the internal sounds 210 by adjusting the internal sounds 210 such that the acoustic pressure of the environmental sounds 110 observed at the reference microphone 130 is reproduced at the eardrum 125. In this embodiment, the controller 205 may determine a first acoustic pressure of the environmental sounds 110 observed by the reference microphone 130 (e.g., based on the first signals 215). The controller 205 may determine a second acoustic pressure of the internal sounds 210 observed by the internal microphones 215 (e.g., based on the second signals 225). The controller 205 may adjust the internal sounds 210 (using the adjusted first signals 235) to mitigate a variation between the first acoustic pressure and the second acoustic pressure. For example, the first signals 215 may be adjusted such that acoustic pressures corresponding to different frequency components of the internal sounds 210 are increased or decreased, acoustic pressures corresponding to amplitudes of the internal sounds 210 at different times are increased or decreased, etc. In this manner, unwanted bias effects of the transfer function H(s) may be mitigated from the internal sounds 210 while matching the second acoustic pressure of the internal sounds 210 to the first acoustic pressure of the environmental sounds 110 more closely.

In one embodiment, the optional adaptive filter 230 may adaptively filter the first signals 215 to correct for the effects of the transfer function H(s). The adaptive filter 230 may be implemented in software, hardware, firmware, or a combination thereof. As shown in FIG. 2, the adaptive filter 230 may reside within the controller 205. In an embodiment (not illustrated in FIG. 2), the adaptive filter 230 may lie outside the controller 205.

The adaptive filter 230 may filter, using an inverse I(s) of the transfer function H(s), the first signals 215 to mitigate effects of the transfer function H(s) from the internal sounds 210. The adaptive filter 230 may adaptively filter the first signals 215 to mitigate the variation between the first signals 215 and the second signals 225. The adaptive filter 230 may be a linear filter having an internal transfer function controlled by variable parameters and a means to adjust those parameters according to an optimization algorithm. The benefits and advantages of using the adaptive filter 230 are that certain parameters (e.g., x(t) and y(t), or the position and orientation of the listening device 200) may not be known in advance or may be changing. Thus the adaptive filter 230 may use feedback in the form of an internal error signal to adaptively refine its filter function.

In one embodiment, the controller 205 may adjust the received environmental sounds 110 (first signals 215) relative to artificial audio content 245 received from an artificial reality system coupled to the listening device 200, a virtual reality audio device, a smartphone, some other device, or a combination thereof. The artificial audio content 245 may be test sounds intended to calibrate the listening device 200, immersive VR cinematic sound, channel-based surround sound, some other audio content, or a combination thereof. The controller 205 may combine the adjusted environmental sounds 110 (the adjusted first signals 235) with the received artificial audio content 245 to generate the internal sounds 210. For example, the controller 205 may combine the adjusted environmental sounds 110 with the artificial audio content 245 to construct and present an audio portion of an immersive artificial reality experience so that what the user hears matches what the user is seeing and interacting with. In embodiment, immersive 3D audio techniques, including binaural recordings and object-based audio, may thus be applied using the listening device 200.

The benefits and advantages, among others, of the embodiments disclosed herein are that the listening device 200 is able to transmit corrected environmental sounds including inherent spatial cues as well as music and speech content during normal usage of the listening device 200 in an artificial reality environment. The ongoing correction by the adaptive filter 230 may be used to adjust the internal sounds 210 as the user walks around a room or moves her jaw, etc. Disruptions to the external portion of the user's ear (e.g., 105) are reduced and normal spatial cues that users use to infer and interpret the external sound field are transmitted to the user. The user can keep the listening device 200 in her ear 105 for long periods of time because the normal listening function is not disrupted.

Architectural Block Diagram of a Controller for Adjusting Environmental Sounds

Figure 3:
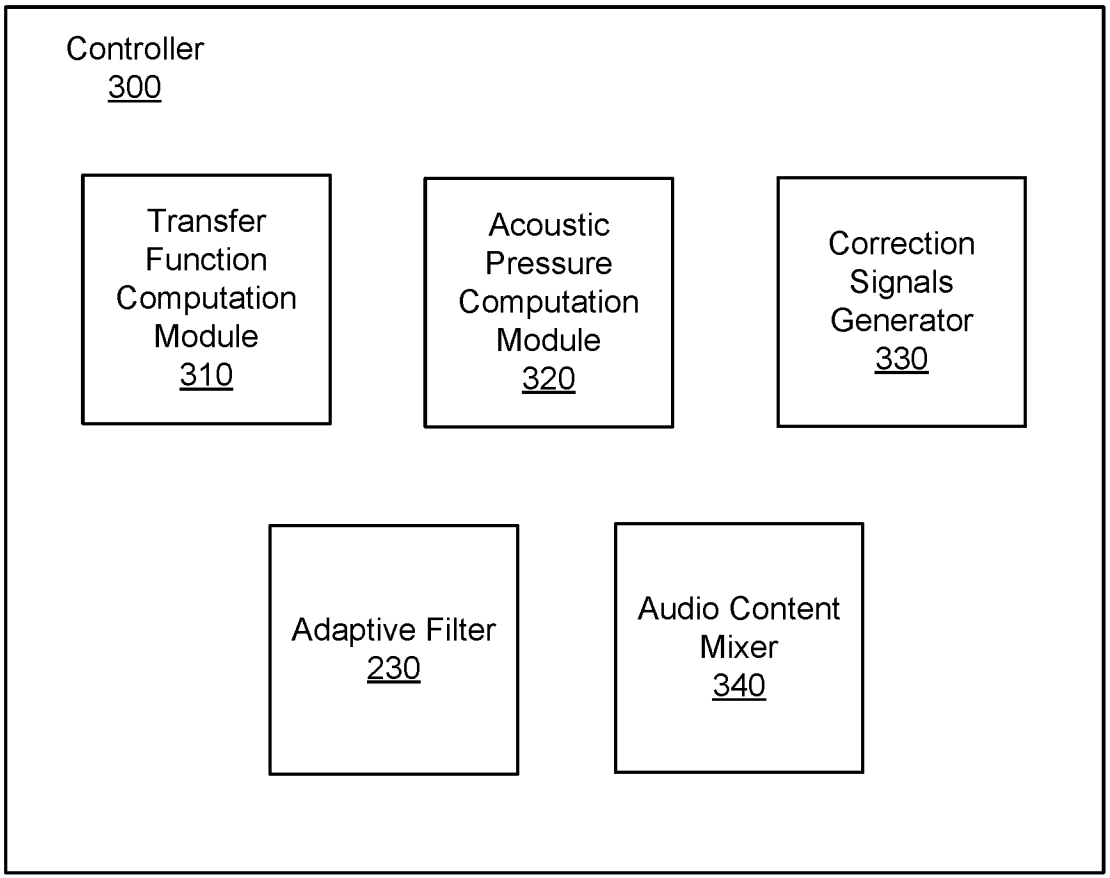
FIG. 3 is an example architectural block diagram of a controller for mitigating a variation between environmental sounds and internal sounds caused by a listening device blocking an ear canal of the user, in accordance with one or more embodiments.

FIG. 3 is an example architectural block diagram of a controller 300 for mitigating a variation between environmental sounds (e.g., 110) and internal sounds (e.g., 210) caused by a listening device (e.g., 200) blocking an ear canal of the user, in accordance with one or more embodiments. The controller 300 may be an embodiment of the controller 145 shown in FIG. 1 or the controller 205 shown in FIG. 2. The controller 300 includes a transfer function computation module 310, an acoustic pressure computation module 320, a correction signals generator 330, an optional adaptive filter (e.g., 230), and an audio content mixer 340. In other embodiments, the controller 300 may include additional or fewer components than those described herein. Similarly, the functions can be distributed among the components and/or different entities in a different manner than is described here.

The transfer function computation module 310 computes a transfer function (e.g., H(s)) based in part on first signals (e.g., 215) and second signals (e.g., 225). The first signals 215 may be generated by a reference microphone (e.g., 130) positioned outside a blocked ear canal (e.g., 115) of a user wearing the listening device 100 based in part on the environmental sounds 110. The second signals 225 may be generated by an internal microphone (e.g., 215) positioned inside the ear canal 115 of the user and configured to receive the internal sounds 210 from a loudspeaker (e.g., 135) and generate the second signals 225.

The transfer function H(s) describes the variation between the environmental sounds 110 and the internal sounds 210 caused by the listening device 200 blocking the ear canal 115 of the user. In one embodiment, the transfer function computation module 310 computes the transfer function H(s) by performing perform spectral estimation on the first signals 215 and the second signals 225 to generate a frequency distribution. For example, the transfer function computation module 310 may perform spectrum analysis, also referred to as frequency domain analysis or spectral density estimation, to decompose the first signals 215 and the second signals 225 into individual frequency components X(s) and Y(s). The transfer function computation module 310 may further quantify the various amounts present in the signals 215 and 225 (e.g., amplitudes, powers, intensities, or phases) versus frequency. The transfer function computation module 310 may perform spectral estimation on the entirety of the first signals 215 and the second signals 220 or the signals 215 and 225 may be broken into samples, and spectral estimation may be applied to the individual samples.

The transfer function computation module 310 may compute the transfer function H(s) based in part on the frequency distribution obtained from the spectral estimation. For example, the transfer function computation module 310 may use linear operations on X(s) and Y(s) in the frequency domain to compute the transfer function H(s) as $H(s)=Y(s)/X(s)$.

The acoustic pressure computation module 320 determines the first acoustic pressure of the environmental sounds 110 observed by the reference microphone 130 (e.g., based on the first signals 215). The first acoustic pressure (or sound pressure) of the environmental sounds 110 received by the reference microphone 130 is the local pressure deviation from the ambient atmospheric pressure caused by the environmental sounds 110. The first acoustic pressure may be recorded and analyzed by the acoustic pressure computation module 320 to determine information about the nature of the path the environmental sounds 110 took from the source to the reference microphone 130. The first acoustic pressure depends on the environment, reflecting surfaces, the distance of the reference microphone 130, ambient sounds, etc.

In an embodiment, the acoustic pressure computation module 320 may determine the first acoustic pressure p1 of the environmental sounds 110 (based in part on the first signals 215) as the local pressure deviation from the ambient pressure caused by sound waves of the environmental sounds 110. The first acoustic pressure p1 may be measured in units of pascals. The acoustic pressure computation module 320 may determine a first particle velocity v1 of the environmental sounds 110 that is the velocity of a particle in a medium as it transmits the environmental sounds 110. The first particle velocity v1 may be expressed in units of meter per second. The acoustic pressure computation module 320 may determine a first acoustic intensity I1 of the environmental sounds 110 as $I1=p1\times v1$. The first acoustic intensity I1 is the power carried by sound waves of the environmental sounds 110 per unit area in a direction perpendicular to that area. The first acoustic intensity I1 may be expressed in watt per square meter.

The acoustic pressure computation module 320 may also determine the second acoustic pressure p2 of the internal sounds 210 observed by the internal microphones 215 (e.g., based on the second signals 225). The user's auditory system analyses the second acoustic pressure for sound localization and spatial cues using directional and loudness evaluation. However, variations in the second acoustic pressure from the first acoustic pressure can lead to unstable directional cues because there may be a mix of sounds reflected by the listening device 200 and the ear canal 115. Therefore, the controller 300 uses the acoustic pressure computation module 320 to adjust the internal sounds 210 such that the acoustic pressure of the internal sounds 210 reaching the eardrum 125 is closer to the acoustic pressure of the environmental sounds 110 received by the reference microphone 130.

In an embodiment, the acoustic pressure computation module 320 may determine a second particle velocity v2 of the internal sounds 210 and a second acoustic intensity I2 of the internal sounds 210 as $I2=p2\times v2$. The acoustic pressure computation module 320 may determine variations between p2 and p1 caused by positional changes of the internal microphone 215. However, the second acoustic intensity I2 of the internal sounds 210 is invariant from the first acoustic intensity I1 of the environmental sounds 110. Therefore, the internal sounds 110 may be adjusted to correct for the variations between p2 and p1.

The correction signals generator 330 generates correction signals (e.g., 240) to adjust the first signals 215 to mitigate effects of the transfer function H(s) from the internal sounds 210. In one embodiment, the correction signals generator 330 generates the correction signals 240 based in part on an inverse I(s) of the transfer function H(s). The correction signals 225 therefore enable the reference microphone 130 and listening device 200 to adjust its performance to meet the desired output response (environmental sounds 110). In one embodiment, the correction signals generator 330 generates the correction signals 240 to adjust the internal sounds 210 to mitigate a variation between the first acoustic pressure p1 and the second acoustic pressure p2.

The correction signals 240 may be negative feedback correction signals that correspond to a variation between a domain transform of the first signals X(s) and a domain transform of the second signals Y(s). When the correction signals (e.g., E(s)) are transmitted to a summer (e.g., 220), a negative feedback loop is created that adjusts the internal sounds (Y(s)) to be closer to the environmental sounds (X(s)). The following equations may be used to determine the corrected internal sounds: $C(s)=X(s)-Y(s)$ and $Yc(s)=H(s)\times Xc(s)$, where Yc(s) refers to the adjusted internal sounds and Xc(s) refers to the adjusted first signals 235. Similar determinations may be made to adjust the signals to account for variations in acoustic pressure.

The optional adaptive filter 230 filters the first signals 215 to mitigate effects of the transfer function H(s) from the internal sounds 210. The adaptive filter 230 changes its filter parameters (coefficients) over time to adapt to changing signal characteristics of the first signals 215 and the second signals 225 by self learning. As the first signals 215 are received by the adaptive filter 230, the adaptive filter 430 adjusts its coefficients to achieve the desired result (i.e., adjusting the first signals 215 and the internal sounds 210 to be closer to the environmental sounds 110).

To define the adaptive filtering process, an adaptive algorithm may be selected to mitigate the error between the signal y(t) (internal sounds 210) and a desired signal d(t) (adjusted internal sounds). For example, the adaptive filter 230 may use an adaptive algorithm such as least mean squares (LMS), recursive least squares (RLS), lattice filtering, filtering that operates in the frequency domain, or a combination thereof. In one embodiment, when the LMS performance criterion for an internal error signal between the first signals 215 and the second signals 225 has achieved its minimum value through the iterations of the adaptive algorithm, the adaptive filter 230's coefficients may converge to a solution. The output from the adaptive filter may now be closer to the desired signal d(t). When the input data characteristics of the environmental sounds 110 change, the adaptive filter 230 adapts by generating a new set of coefficients for the new signal characteristics.

In one embodiment, the adaptive filter 230 filters, using an inverse I(s) of the transfer function H(s), the first signals 215 to mitigate a variation between the first acoustic pressure p1 and the second acoustic pressure p2. By placing the adaptive filter 230 in series with the forward path of the listening device 200 as shown in FIG. 2, the adaptive filter 230 adapts to the inverse I(s) of the transfer function H(s) to mitigate the variation between the first acoustic pressure p1 and the second acoustic pressure p2.

The audio content mixer 340 may combine the received environmental sounds 110 with received artificial audio content (e.g., 245) to generate the internal sounds 210. The audio content mixer 340 may mix ambient sounds with sounds corresponding to an artificial reality display. In one embodiment, the listening device 200 may have a sliding control for blocking part of the environmental sounds 110 or part of the artificial audio content 245 to varying degrees, e.g., 100% ambient sound, 55% ambient sound+25% artificial audio content, etc. The audio content mixer 340 may receive information in the form of a signal from the sliding control to control the environmental sounds 110, the received artificial audio content 245, or both.

The audio content mixer 340 may adjust the environmental sounds 110 relative to the artificial audio content 245. The audio content mixer 340 may adjust the environmental sounds 110 by increasing or decreasing a level of the environmental sounds 110 relative to a level of the artificial audio content 245 to generate the internal sounds 210. For example, the volume level, frequency content, dynamics, and panoramic position of the environmental sounds 110 may be manipulated and or enhanced. The levels of speech (dialogue, voice-overs, etc.), ambient noise, sound effects, and music in the artificial audio content 245 may be increased or decreased relative to the environmental sounds 110.

The audio content mixer 340 may combine the adjusted environmental sounds 110 with the artificial audio content 245 into one or more channels. For example, the adjusted environmental sounds 110 and the artificial audio content 245 may be electrically blended together to include sounds from instruments, voices, and pre-recorded material. Either the environmental sounds 110 or the artificial audio content 245 or both may be equalized and/or amplified and reproduced via the loudspeaker 135.

Figure 4:
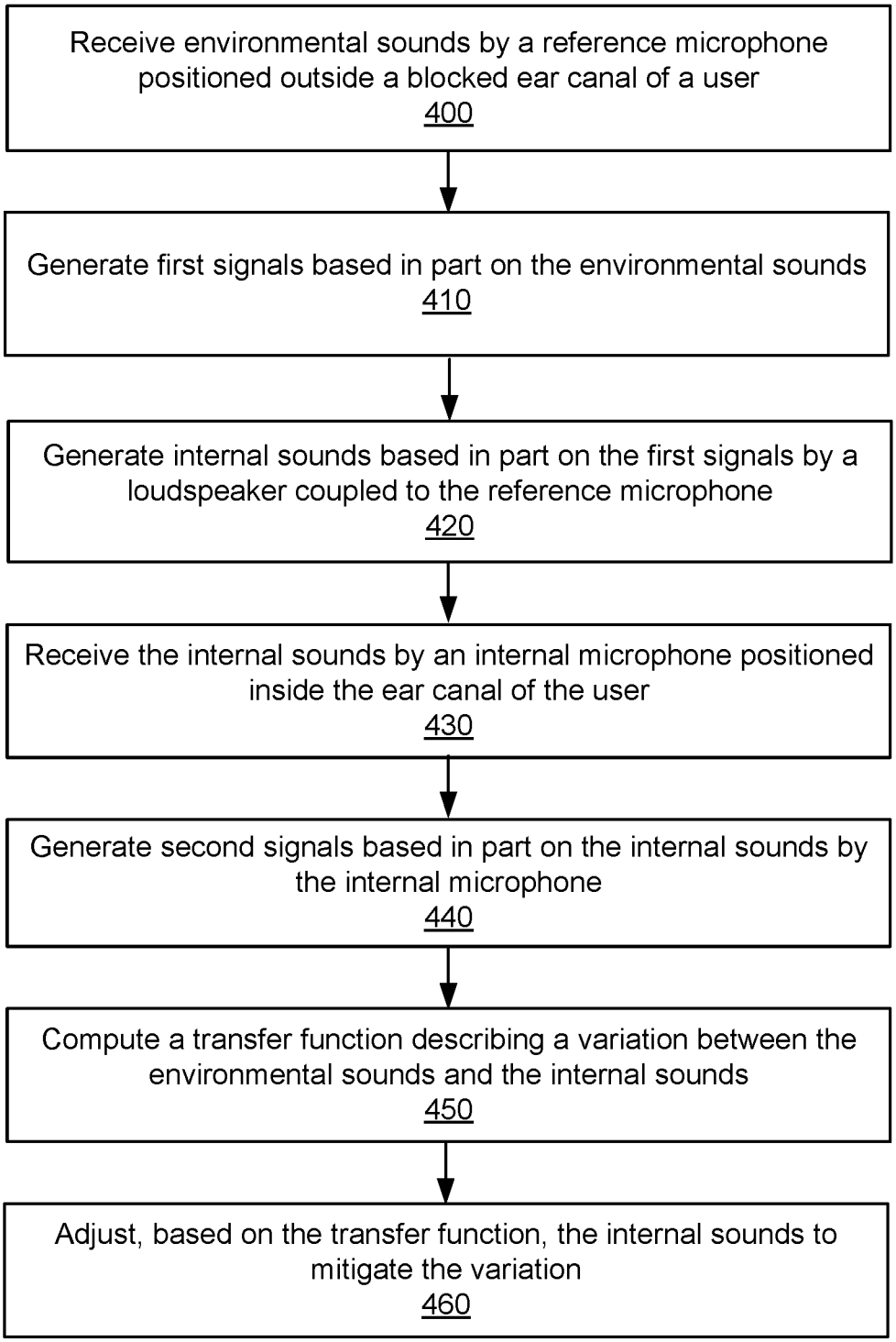
FIG. 4 is an example process for mitigating a variation between environmental sounds and internal sounds caused by a listening device blocking an ear canal of the user, in accordance with one or more embodiments.

Example Process for Mitigating Variation Between Environmental Sounds and Internal Sounds FIG. 4 is an example process for mitigating a variation between environmental sounds (e.g., 110) and internal sounds (e.g., 210) caused by a listening device (e.g., 100) blocking an ear canal (e.g., 115) of a user, in accordance with one or more embodiments. In one embodiment, the process of FIG. 4 is performed by a listening device (e.g., 100). Other entities (e.g., an HMD) may perform some or all of the steps of the process in other embodiments. Likewise, embodiments may include different and/or additional steps, or perform the steps in different orders.

The listening device 100 receives 400 the environmental sounds 110 using a reference microphone (e.g., 130). The reference microphone 130 is positioned outside a blocked ear canal of a user wearing the listening device 100.

The listening device 100 generates 410 first signals (e.g., 215) based in part on the environmental sounds 110. The first signals 215 may be electrical signals (e.g., voltage, current, digital signals, or a combination thereof.) The reference microphone 130 may include a transducer that converts air pressure variations of the environmental sounds 110 to the first signals 215. For example, the reference microphone 130 may include a coil of wire suspended in a magnetic field, a vibrating diaphragm, a crystal of piezoelectric material, some other transducer, or a combination thereof.

The listening device 100 generates 420 the internal sounds 210 based in part on the first signals 215 by a loudspeaker (e.g., 135) that is coupled to the reference microphone 130. The loudspeaker 135 may include an electroacoustic transducer to convert the first signals 215 to the internal sounds 210. The loudspeaker 135 may include a voice coil, a piezoelectric speaker, a magnetostatic speaker, some other mechanism to convert the first signals 215 to the internal sounds 210, or a combination thereof.

The listening device 100 receives 430 the internal sounds 210 using an internal microphone (e.g., 140). The internal microphone 140 is also positioned inside the ear canal 115 of the user.

The listening device 100 generates 440 second signals (e.g., 225) corresponding to the internal sounds 210. The second signals 225 may be electrical signals (e.g., voltage, current, digital signals, or a combination thereof.) The internal microphone 140 may generate the second signals 225 in a manner described above with respect to the reference microphone 130.

The listening device 100 computes 450 a transfer function (e.g., H(s)) based in part on the first signals 215 and the second signals 225. The transfer function H(s) describes a variation between the environmental sounds 110 and the internal sounds 210. For example, the variation may be caused by the listening device 100 blocking the ear canal 115 of the user. The listening device 100 may perform spectral estimation on the first signals 215 and the second signals 225 to generate a frequency distribution. The listening device 100 may compute the transfer function H(s) from the frequency distribution.

The listening device 100 adjusts 460, based on the transfer function H(s), the internal sounds 210 to mitigate the variation. The listening device 100 may adjust the internal sounds 210 by using a controller (e.g., 205) to generate correction signals (e.g., 240) based on an inverse I(s) of the transfer function H(s). The controller 205 may use the correction signals 240 to adjust the first signals 215 to mitigate effects of the transfer function H(s) from the internal sounds 210. In one embodiment, an adaptive filter (e.g., 230) may filter, using an inverse I(s) of the transfer function H(s), the first signals 215 to mitigate effects of the transfer function H(s) from the internal sounds 210.

Additional Configuration Information

The listening device (e.g., 100) may be part of an HMD coupled to an artificial reality system, including base stations to provide audio content, and a console. In embodiments, a part of the functionality of the controller (e.g., 145) may be performed by a console to which the listening device 100 is coupled. One or more base stations may further include a depth camera assembly to determine depth information describing a position of the listening device 100 or HMD in the local area relative to the locations of the base stations.

The HMD may further include an inertial measurement unit (IMU) including one or more position sensors to generate signals in response to motion of the HMD. Examples of position sensors include: accelerometers, gyroscopes, magnetometers, another suitable type of sensor that detects motion, a type of sensor used for error correction of the IMU, or some combination thereof. The audio content (e.g., 230) and environmental sounds (e.g., 110) may be further adjusted based on the signals corresponding to motion of the user.

The artificial reality system may provide video content to the user via the HMD, where the audio content (e.g., 230) corresponds to the video content, and the video content corresponds to the position of the listening device 100 or HMD to provide an immersive artificial reality experience.

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A listening device comprising:

a reference microphone positioned outside a blocked ear canal of a user wearing the listening device and configured to receive environmental sounds and generate first signals based in part on the environmental sounds;

a loudspeaker coupled to the reference microphone and positioned inside the ear canal of the user, the loudspeaker configured to generate internal sounds based in part on the first signals;

an internal microphone positioned inside the blocked ear canal of the user and configured to receive the internal sounds from the loudspeaker and generate second signals based in part on the internal sounds; and a controller coupled to the internal microphone, to the reference microphone, and to the loudspeaker, the controller configured to:

compute a transfer function based in part on the first signals and the second signals, the transfer function describing a variation between the environmental sounds and the internal sounds caused by the listening device blocking the ear canal of the user, receive artificial audio content from an artificial reality system coupled to the listening device, adjust the environmental sounds relative to the artificial audio content, generate the internal sounds by combining the artificial audio content and the adjusted environmental sounds, and adjust, based in part on the transfer function, the internal sounds to mitigate the variation.

2. The listening device of claim 1, wherein the controller is configured to compute the transfer function by executing steps to:

perform spectral estimation on the first signals and the second signals to generate a frequency distribution; and compute the transfer function based in part on the frequency distribution.

3. The listening device of claim 1, wherein the controller is configured to adjust the internal sounds by performing steps to:

generate correction signals based in part on an inverse of the transfer function; and adjust the first signals, based in part on the correction signals, to mitigate effects of the transfer function from the internal sounds.

4. The listening device of claim 1, wherein the controller comprises an adaptive filter configured to filter, based in part on an inverse of the transfer function, the first signals to mitigate effects of the transfer function from the internal sounds.

5. The listening device of claim 1, wherein the listening device is configured to adjust the environmental sounds relative to the received artificial audio content by increasing or decreasing a level of the environmental sounds relative to a level of the received artificial audio content.

6. The listening device of claim 1, further comprising a second internal microphone positioned inside the ear canal of the user and configured to receive the internal sounds from the loudspeaker, wherein the listening device is configured to determine a first acoustic pressure of the environmental sounds received by the reference microphone and a second acoustic pressure of the internal sounds received by the second internal microphone.

7. The listening device of claim 6, wherein the controller is further configured to:

determine a variation between the first acoustic pressure and the second acoustic pressure; and adjust the internal sounds to mitigate the variation between the first acoustic pressure and the second acoustic pressure.

8. The listening device of claim 7, wherein the controller is further configured to adjust the internal sounds to mitigate the variation between the first acoustic pressure and the second acoustic pressure by performing steps to:

generate correction signals based in part on the variation between the first acoustic pressure and the second acoustic pressure; and adjust the first signals, based in part on the correction signals, to mitigate the variation between the first acoustic pressure and the second acoustic pressure.

9. The listening device of claim 7, wherein the controller comprises an adaptive filter configured to filter, based in part on the variation between the first acoustic pressure and the second acoustic pressure, the first signals to mitigate the variation between the first acoustic pressure and the second acoustic pressure.

10. A method comprising:

receiving environmental sounds by a reference microphone positioned outside a blocked ear canal of a user wearing a listening device;

receiving artificial audio content from an augmented reality system coupled to the listening device;

adjusting the environmental sounds relative to the artificial audio content;

generating first signals by combining the adjusted environmental sounds and the artificial audio content;

generating internal sounds based in part on the first signals by a loudspeaker coupled to the reference microphone and positioned inside the ear canal of the user;

receiving the internal sounds from the loudspeaker by an internal microphone positioned inside the ear canal of the user;

generating second signals based in part on the internal sounds;

computing a transfer function based in part on the first signals and the second signals, the transfer function describing a variation between the environmental sounds and the internal sounds caused by the listening device blocking the ear canal of the user; and adjusting, based in part on the transfer function, the internal sounds to mitigate the variation.

11. The method of claim 10, wherein the computing of the transfer function comprises:

performing spectral estimation on the first signals and the second signals to generate a frequency distribution; and computing the transfer function based in part on the frequency distribution.

12. The method of claim 10, wherein the adjusting of the internal sounds comprises:

generating correction signals based in part on an inverse of the transfer function; and adjusting the first signals, based in part on the correction signals, to mitigate effects of the transfer function from the internal sounds.

13. The method of claim 10, wherein the adjusting of the internal sounds comprises filtering, by an adaptive filter, based in part on an inverse of the transfer function, the first signals to mitigate effects of the transfer function from the internal sounds.

14. The method of claim 10, further comprising:

receiving the internal sounds from the loudspeaker by a second internal microphone positioned inside the ear canal of the user; and determining a first acoustic pressure of the environmental sounds received by the reference microphone and a second acoustic pressure of the internal sounds received by the second internal microphone.

15. The method of claim 14, further comprising:

determining a variation between the first acoustic pressure and the second acoustic pressure; and adjusting the internal sounds to mitigate the variation between the first acoustic pressure and the second acoustic pressure.

16. The method of claim 15, wherein the adjusting of the internal sounds to mitigate the variation between the first acoustic pressure and the second acoustic pressure comprises:

generating correction signals based in part on the variation between the first acoustic pressure and the second acoustic pressure; and adjusting the first signals, based in part on the correction signals, to mitigate the variation between the first acoustic pressure and the second acoustic pressure.

17. The method of claim 15, wherein the adjusting of the internal sounds to mitigate the variation between the first acoustic pressure and the second acoustic pressure comprises filtering, by an adaptive filter, based in part on the variation between the first acoustic pressure and the second acoustic pressure, the first signals to mitigate the variation between the first acoustic pressure and the second acoustic pressure.

18. A non-transitory computer-readable medium storing instructions executable by a processor and comprising instructions for:

receiving environmental sounds by a reference microphone positioned outside a blocked ear canal of a user wearing a listening device;

receive artificial audio content from an augmented reality system coupled to the listening device;

adjust the environmental sounds relative to the artificial audio content;

generating first signals by combining the adjusted environmental sounds and the artificial audio content;

generating internal sounds based in part on the first signals by a loudspeaker coupled to the reference microphone and positioned inside the ear canal of the user;

receiving the internal sounds from the loudspeaker by an internal microphone positioned inside the ear canal of the user;

generating second signals based in part on the internal sounds;

computing a transfer function based in part on the first signals and the second signals, the transfer function describing a variation between the environmental sounds and the internal sounds caused by the listening device blocking the ear canal of the user; and adjusting, based in part on the transfer function, the internal sounds to mitigate the variation.

* * * * *